United States Patent [19]

Fesseden

[11] 3,936,363

[45] Feb. 3, 1976

[54] ELECTROLYTIC METAL RECOVERY PROCESS AND APPARATUS

[75] Inventor: John R. Fesseden, Rochester, N.Y.

[73] Assignee: Eastman Kodak Company, Rochester, N.Y.

[22] Filed: May 8, 1974

[21] Appl. No.: 467,963

[52] U.S. Cl...... 204/105 R; 204/109; 204/263; 204/275

[51] Int. Cl.[2].... C25C 1/22; C25C 1/00; C25C 7/00

[58] Field of Search..... 204/109, 263, 275, 105 R

[56] References Cited

UNITED STATES PATENTS

| | | | |
|---|---|---|---|
| 3,616,286 | 10/1971 | Aylward et al. | 204/275 |
| 3,649,509 | 3/1972 | Morawetz et al. | 204/275 |
| 3,728,244 | 4/1973 | Cooley | 204/109 |
| 3,751,351 | 8/1973 | Zankowski | 204/275 |
| 3,751,355 | 8/1973 | Mandroian | 204/109 |

*Primary Examiner*—R. L. Andrews
*Attorney, Agent, or Firm*—T. H. Close

[57] ABSTRACT

Apparatus for electrolytically recovering metallic ions from a solution is disclosed in which the solution is passed through a sealed electrolytic cell by operating the cell under negative pressure.

14 Claims, 3 Drawing Figures

ELECTROLYTIC METAL RECOVERY PROCESS AND APPARATUS

BACKGROUND OF THE INVENTION

1. Field of the Invention

This invention relates to the electrolytic recovery of metals and, more particularly, to apparatus for electrolytically recovering a metal from a solution containing ions of the metal in which an electrolytic cell is operated under negative pressure.

2. Description of the Prior Art

The technique of electrolytically recovering a metal from a solution which contains ions of such metal is well known. Regardless of the design of the apparatus employed, it has long been recognized that effective agitation of the solution must be provided to achieve a reasonable efficiency of recovery. Many prior art electrolytic cells utilized in metal recovery apparatus provide mechanical agitation of the solution by the use of inter-electrode stirring devices, e.g., rotating paddle-wheels or impellers positioned between an anode and a cathode in the cell. Such cells are typically of rather complex construction and relatively large, since space must be provided between the cell anode and the cathode to accommodate the stirring devices.

Recently, smaller, sealed electrolytic cells of relatively simple design have been developed which produce a turbulence in the electrolytic solution flowing through them by directing the flow along a path of a particular geometry. The solution agitation resulting from this turbulence is sufficient to eliminate the need for using mechanical stirring devices in the cells. Examples of cells of this type are described in the following U.S. patents: A. C. Cooley, U.S. Pat. No. 3,728,244, issued Apr. 17, 1973; and J. S. Zankowski, U.S. Pat. No. 3,751,351, issued Aug. 7, 1973. Cells such as, for example, the Cooley and Zankowski cells, have in the past been operated under a positive pressure. The Zankowski cell consists of a housing that holds an anode and a cathode in contact with the opposite edges of a spiral-like or involute partition. The involute partition directs solution flow along a spiral path through the cell, between the anode and cathode, and produces sufficient agitation of the solution to allow efficient electrolytic plating. Since solution agitation is produced in a Zankowski cell by directing a solution along a spiral path defined by a partition, solution agitation and, hence, the efficiency of the cell, is reduced if part of the solution flowing through the cell leaks between partition sections, instead of following the spiral path defined by the partition. Obviously, the probability of such leakage occurring is increased when the solution is forced through the cell under positive pressure, as is done in the prior art. The pressure created by forcing the solution through the cell tends to produce a bulge in the cell enclosure, and this may result in the anode or cathode, or both, separating from the edges of the involute partition, producing an opening through which the solution leaks between sections of the partition. To eliminate this problem, the cell is constructed of relatively expensive, rigid materials, which add to the cost of producing a cell. Additionally, another problem resulting from operating a cell under positive pressure is the safety hazard that can arise if the cell housing fractures or bursts, and debris and solution are hurled outwardly from the cell as a result of such pressure. In summary, while the prior art practice of using a positive pressure to force a solution through an electrolytic cell produces satisfactory results, this practice requires the use of a relatively expensive cell and presents a potential safety hazard in the event the cell housing is damaged.

SUMMARY OF THE INVENTION

The invention eliminates the problems inherent in prior art electrolytic metal recovery apparatus by operating a sealed electrolytic cell used in such apparatus under a negative pressure. More specifically, ion bearing solution is circulated through the cell by reducing pressure in the cell below the pressure in the environment in which the cell is used. Normally, electrolytic cells are used in atmospheric pressure; whereas, the cell used in the present invention is operated by maintaining the pressure in its interior below atmospheric pressure. The pressure differential created by such operation forces the various cell components together, producing a good seal, and eliminates the possibility of debris and solution being hurled outwardly from the cell if the cell is fractured or broken.

The advantages of operating an electrolytic cell under negative pressure in accordance with the invention are apparent. Since such operation reduces the possibility of solution leakage from the cell enclosure, and leakage between sections of the partition within the enclosure of a cell, such as a Zankowski cell, the cell is more reliable and efficient. Furthermore, operating a cell under negative pressure eliminates the need to use expensive, rigid materials in the construction of the cell components to avoid leakage problems, and this allows the cost of producing a cell to be reduced. Additionally, as a result of the increased efficiency of a cell operated under negative pressure, the solution may be circulated through the cell at a lower flow rate, allowing the use of a low capacity pump for circulating the solution. The use of a low capacity pump eliminates problems that can arise due to cavitation when high capacity pumps are used in a negative pressure system. Finally, negative pressure operation of a cell eliminates a potential safety hazard.

OBJECTS OF THE INVENTION

It is an object of this invention to provide improved apparatus for electrolytically recovering metallic ions from solutions.

Another object of this invention is to increase the efficiency of electrolytic metal recovery apparatus that includes a sealed electrolytic cell by operating the cell under negative pressure.

Another object of this invention is to provide electrolytic apparatus that is suitable for use in automatic film processing equipment for removing silver ions from photographic fixing solutions used in the equipment.

Still another object of the present invention is to reduce the cost of electrolytic cells used in electrolytic metal recovery apparatus.

A still further object of the invention is to provide electrolytic metal recovery apparatus in which the seal between the internal components of an electrolytic cell in the apparatus is improved by operating the cell under negative pressure created by a pump used to circulate solution through the cell.

The invention, and its objects and advantages, will become more apparent in the detailed description of the illustrative embodiment presented below.

BRIEF DESCRIPTION OF THE DRAWINGS

In the detailed description of the illustrative embodiment of the invention presented below, reference is made to the accompanying drawings, in which.

DESCRIPTION OF THE ILLUSTRATIVE EMBODIMENT

Figure 1:
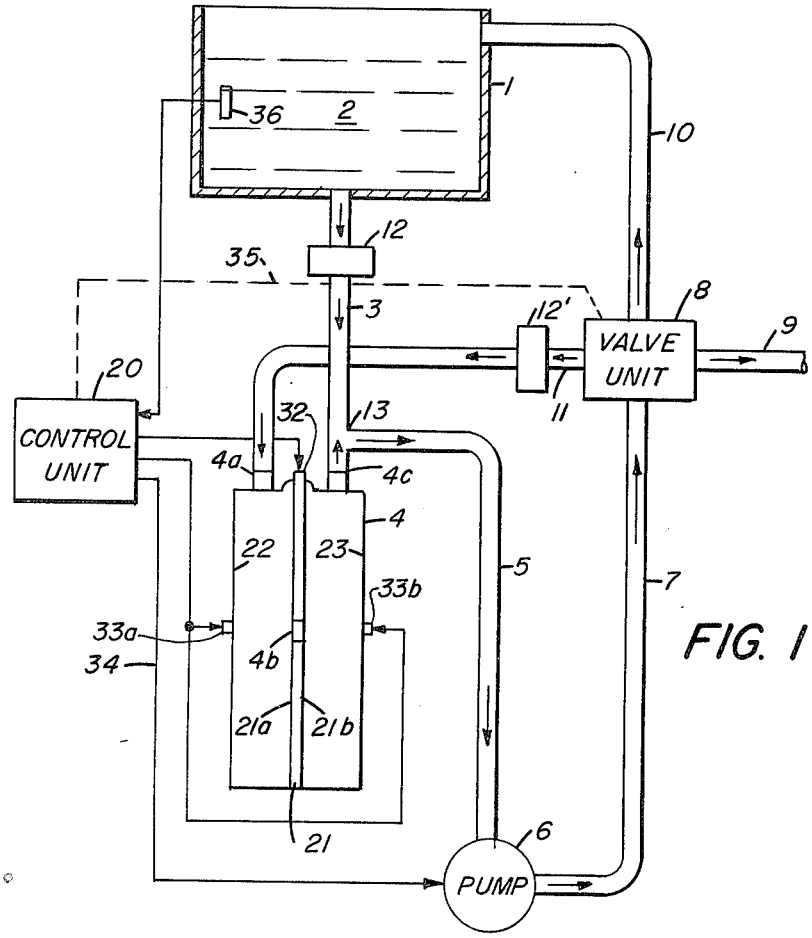
FIG. 1 is a schematic drawing of illustrative electrolytic silver recovery apparatus embodying the invention.
Figure 2:
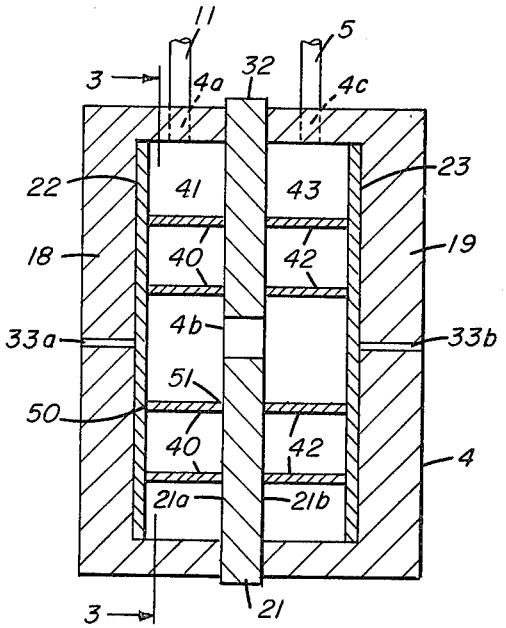
FIG. 2 is a vertical sectional view of a double chamber electrolytic cell, taken along line 2—2 in FIG. 3, that is suitable for use in the illustrative embodiment shown in FIG. 1.
Figure 3:
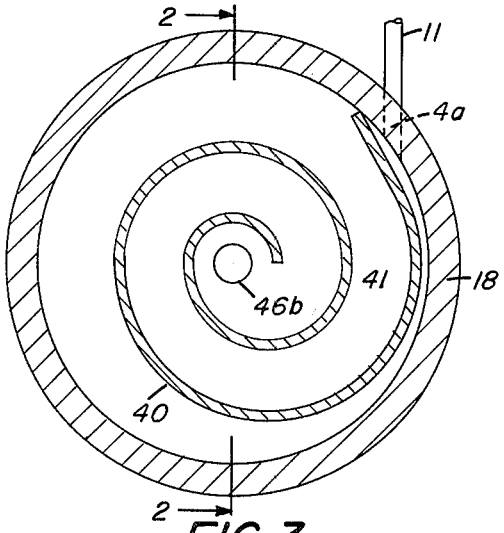
FIG. 3 is an elevational view, partly in section, taken along line 3—3 in FIG. 2 for one chamber of the cell.

In the apparatus represented by FIG. 1, the operation of a pump 6 reduces the pressure inside an electrolytic cell 4, and at the pressure reduction device 12, resulting in a solution 2, such as a photographic fixing solution, in a container 1 being drawn through the cell and the pressure reduction device 12. Views of one type of a cell 4 suitable for use with such apparatus are shown in FIGS. 2 and 3. Such a cell 4 may be comprised of two flexible shells, 18 and 19, sealed together to form a housing which encloses two flexible anodes, 22 and 23, a flexible cathode 21, a first involute partition 40 separating the anode 22 and the cathode 21, and a second involute partition 42, similar to the partition 40, separating the anode 23 and the cathode 21. The pressure reduction device 12, along with a similar device 12′, may be any one of numerous well-known devices that allow the pump 6 to reduce the pressure in the flow path of the solution between the two devices 12, 12′, and the intake of the pump 6. For example, these devices could be orifices restricting the solution flow path or pressure reduction valves.

As a result of the operation of the pump 6 (FIG. 1), the solution 2 is drawn through the pressure reduction device 12, the tube 3, the junction 13, and the tube 5 into the intake side of the pump 6. When the solution is being recirculated, it is pumped from the outlet side of the pump 6 through the valve unit 8, the pressure reduction device 12′, and the tube 11 into the inlet 4*a* of the cell 4. The reduced pressure in the cell 4, produced by the pump suction, results in the solution being drawn through an inwardly turning path 41 defined by the partition 40 (FIG. 3), located between the cathode surface 21*a* (FIG. 2) and the anode 22, to the center of the cell 4. At this point, the solution is drawn through an opening 4*b* in the center of the cathode 21. The solution is then drawn through an outwardly turning path 43 (FIG. 2), defined by the partition 42, located between the cathode surface 21*b* and the anode 23, to the periphery of the cell 4 where it leaves the cell through an outlet opening 4*c*. After leaving the cell at the outlet 4*c*, the solution is drawn through the junction 13 (FIG. 1), along with solution 2 from the container 1, through the tube 5, and passes through the pump 6 for recirculation. A difference in potential applied to the anodes 22, 23 and the cathode 21 results in the metal ions in the circulating solution being deposited on the cathode surfaces 21*a* and 21*b*.

As previously mentioned, when the solution is circulated through the cell 4 under positive pressure, there is a tendency for the solution to leak around the edges of the partitions 40, 42 (FIG. 2); for instance, along the path 50 where the partition 40 meets the anode 22 and along the path 51 where partition 40 meets the cathode surface 21*a*. This tendency, however, is minimized when the cell 4 is operated under negative pressure in accordance with the invention. More specifically, since atmospheric pressure is greater than the pressure within the cell, a force is exerted on the exterior surface of the cell 4 that compresses the cell housing, and this results in the elements inside the cell being held in tight, substantially leakproof contact.

The solution drawn from the container 1 (FIG. 1) and the cell 4, by the pump 6, travels through the pump and a tube 7 to a valve unit 8. The valve unit 8 controls the amount of solution directed through a tube 11 for recirculation through the cell 4, through a tube 10 which returns the solution to the container 1, and through a tube 9 which drains solution from the recovery apparatus. The valve unit 8 may be three individually adjustable valves, one three-way valve, or any other suitable means for controlling the amount of solution that is diverted into the tubes 9, 10, and 11. The valves may be either manually adjusted or adjusted by an electrical control unit 20.

Since the valve unit 8 (FIG. 1) is on the positive pressure side of the pump 6, the solution directed into the tube 11 for recirculation through the cell 4 is under a positive pressure. As previously mentioned, the cell 4 is operated under negative pressure and, hence, it operates most efficiently if it is supplied solution at substantially atmospheric pressure. Consequently, the pressure reduction device 12′ is included as part of the tube 11 to reduce the solution pressure travelling in this tube toward the inlet opening 4*a* of the cell to approximately atmospheric pressure. Additionally, it is obvious that various other valves may be included in the apparatus to purge it of air and to control the solution pressure in the tubes.

The operation of the apparatus is controlled by signals generated by a control unit 20. Since this control unit may be any one of a number of well-known electrical control devices, it will not be described in detail. A sensor 36 provides the control unit 20 with a signal that represents the silver content of the solution 2. Alternatively, the control unit 20 may be supplied a signal indicating the amount and type of film conveyed through the solution 2. In response to the application of either of these signals, the control unit 20 which is attached to the cathode 21 at 31 and to the anodes 22 and 23 at 33*a* and 33*b* respectively applies a DC difference in potential between the cell's anodes and cathode to produce a current flow through the cell that results in the efficient recovery of the silver in the solution. The control unit 20 also controls the application of power to the pump 6 via line 34 and, as mentioned above, it may also control the operation of the valve unit 8 by signals transmitted over the line 35.

In essence, the foregoing has disclosed an invention that overcomes the problems inherent in the operation of prior art electrolytic metal recovery apparatus by operating the electrolytic cell used in such apparatus under a negative pressure. While the invention has been described in terms of a particular illustrative embodiment using a particular type of electrolytic cell to recover silver ions from a photographic fixing solution, it is clear that the invention is not limited to such an embodiment. Obviously, the invention is useful in electrolytic recovery apparatus that recovers metals other than silver. Similarly, the electrolytic cell described is merely illustrative and can be replaced with other types of cells. Additionally, it is further apparent that the amount of the negative pressure utilized during the metal recovery process depends upon the apparatus being used, the cell design, the nature of the material used to construct the cell, and the type of solution being processed.

In summary, the invention has been described in detail with particular reference to an illustrative embodiment thereof, but it will be understood that variations and modifications can be effected within the spirit and scope of the invention as described hereinabove, and as defined in the appended claims.

I claim:

1. A system for electrolytically removing metal from a solution containining ions thereof, comprising, in combination, an electrolytic cell comprising an enclosed chamber having at least one cathode and at least one anode adapted to be connected to means for impressing an electrical potential, said cell being sealed, against communication with the ambient atmosphere, and said cell having an inlet and an outlet for solution; a source of such a solution; conduit means connected between said outlet and said inlet for recycling solution through said cell, said conduit means comprising a first conduit connected to said inlet for supplying solution to said cell; a second conduit connected to said outlet for removing solution from said cell; a pump having an inlet connected to said second conduit and an outlet connected to said first conduit, said pump being so constructed and arranged as to suck solution from said cell and said second conduit at a subatmosphere pressure and to discharge solution to said first conduit, whereby to maintain a subatmosphere pressure in said cell; and a third conduit connecting said source to said conduit means for supplying solution to said cell.

2. A system in accordance with claim 1, also comprising a pressure reduction device between said outlet of said pump and said inlet of said cell for reducing the pressure of solution entering said cell.

3. Apparatus for electrolytically recovering metals from a solution furnished the apparatus from a source, the solution containing ions of the metal to be recovered, the apparatus comprising:

an electrolytic cell comprising two shells sealed together to form a cell housing having an inlet and an outlet, a first electrode disposed within said housing, a second electrode disposed within said housing spaced apart from said first electrode, and partition means extending between said first and second electrodes and forming therewith a passageway between said inlet and said outlet;

means for applying a voltage to said electrodes;

means for defining a solution flow path between the source and said cell; and means for reducing the pressure of solution at said outlet thereby creating a negative pressure within said cell to draw solution into, through, and out of said cell, the ions being deposited on one of said electrodes as the solution passes through said cell, said shells being responsive to negative pressure within said cell to flex towards each other thereby reducing leakage from the cell housing.

4. An apparatus as claimed in claim 3 further comprising at least one means for controlling pressure within the means for defining a solution flow path.

5. An apparatus as claimed in claim 3 wherein the means for reducing the pressure comprises a pump.

6. An apparatus as claimed in claim 3 wherein said means for defining a solution flow path recirculates through the electrolytic cell at least a portion of the solution leaving the electrolytic cell before returning it to the source.

7. Apparatus for electrolytically recovering metals from a solution furnished the apparatus from a source, the solution containing ions of the metal to be recovered, the apparatus comprising:

an electrolytic cell including a cell housing having an inlet, an outlet, a flexible cell wall, a first electrode disposed within said cell housing generally parallel to said flexible cell wall, a second electrode disposed within said cell housing spaced apart from said first electrode, and partition means extending between said first and second electrodes and forming therewith a passageway between said inlet and said outlet;

means for applying a voltage to said electrodes;

means for defining a solution flow path between the source and said electrolytic cell; and means for reducing the pressure of solution at said outlet thereby creating a negative pressure within said electrolytic cell to draw solution into, through, and out of said cell, the ions being deposited on one of said electrodes as the solution passes through said electrolytic cell, said flexible cell wall being responsive to negative pressure within said cell to flex towards the interior of said electrolytic cell, said electrodes and said partition means being related to said flexible wall such that the electrodes and said partition means are urged into sealing contact with one another in response to flexing of said wall toward the interior of said cell.

8. An apparatus as claimed in claim 7 further comprising at least one means for controlling pressure within the means for defining a solution flow path.

9. An apparatus as claimed in claim 7 wherein the means for reducing the pressure comprises a pump.

10. An apparatus as claimed in claim 7 wherein said means for defining a solution flow path recirculates through the electrolytic cell at least a portion of the solution leaving the electrolytic cell before returning it to the source.

11. An apparatus as claimed in claim 7 wherein said cell housing is comprised of two flexible shells in sealing relation, said shells being urged together to enhance said sealing relation in response to negative pressure being created within said electrolytic cell.

12. A method for electrolytically recovering metal from a solution containing ions of the metal using a sealed, electrolytic cell having flexible cell walls, an inlet, an outlet, and electrodes separated by partition means for forming a passageway from the inlet to the outlet for the solution, the method comprising:

delivering the solution from a source to the cell;

applying a plating voltage to the electrodes whereby the ions in the solution are deposited on at least one of the electrodes as the solution flows through the cell;

creating a negative pressure at the outlet of the cell for drawing the solution into, through, and out of the cell, whereby the walls of the cell are flexed toward the interior of the cell in response to negative pressure within the cell to compress the partition means between the electrodes so that leakage around the partition means between the parts of the passageway is reduced.

13. The method of claim 12, including:

delivering a portion of the solution leaving the cell to the source; and returning a portion of the solution leaving the cell to the cell.

14. The method according to claim 12 further comprising:

controlling the pressure of the solution furnished to the cell.

* * * * *

UNITED STATES PATENT OFFICE

CERTIFICATE OF CORRECTION

PATENT NO. : 3,936,363

DATED : February 3, 1976

INVENTOR(S) : John R. Fessenden

It is certified that error appears in the above-identified patent and that said Letters Patent are hereby corrected as shown below:

On the Title Page, change Inventor's name from "John R. Fesseden" to --John R. Fessenden--

Signed and Sealed this

Seventeenth Day of August 1976

[SEAL]

*Attest:*

RUTH C. MASON
*Attesting Officer*

C. MARSHALL DANN
*Commissioner of Patents and Trademarks*